US006253377B1

(12) United States Patent
Lascala

(10) Patent No.: US 6,253,377 B1
(45) Date of Patent: Jul. 3, 2001

(54) CHAPS

(76) Inventor: Linda Lascala, 1157 Sunset Dr. 24-B, Delevan, NY (US) 14042

( * ) Notice: Subject to any disclaimer, the term of this patent is extended or adjusted under 35 U.S.C. 154(b) by 0 days.

(21) Appl. No.: 09/645,241

(22) Filed: Aug. 24, 2000

(51) Int. Cl.[7] ..... A41D 13/00
(52) U.S. Cl. ..... 2/46; 2/22
(58) Field of Search ..... 2/46, 22, 24, 51, 2/242, 911, 455, 227, 79, 122, 82, 232

(56) References Cited

U.S. PATENT DOCUMENTS

| | | | | |
|---|---|---|---|---|
| 1,885,527 | * | 11/1932 | Luft | 2/227 |
| 4,843,654 | * | 7/1989 | March | 2/227 |
| 5,033,124 | * | 7/1991 | Bucalo et al. | 2/227 |
| 5,088,116 | * | 2/1992 | Gould | 2/82 |
| 5,095,544 | * | 3/1992 | Elverskog | 2/22 |
| 5,115,518 | * | 5/1992 | Hofman | 2/227 |
| 5,375,262 | * | 12/1994 | Carter | 2/23 |
| 5,416,928 | * | 5/1995 | Koenig | 2/244 |
| 5,526,532 | * | 6/1996 | Willard | 2/69 |
| 5,611,082 | * | 3/1997 | Bull | 2/79 |
| 5,758,363 | * | 6/1998 | Winfree | 2/122 |
| 5,864,888 | * | 2/1999 | Archer | 2/227 |

FOREIGN PATENT DOCUMENTS

| | | | |
|---|---|---|---|
| 2636816 | * | 9/1989 | (FR) . |
| 317912 | * | 10/1902 | (NL) . |

* cited by examiner

*Primary Examiner*—John J. Calvert
*Assistant Examiner*—Tejash Patel

(57) ABSTRACT

This invention is directed to an improved pair of chaps (15) for use by a rider when riding a horse. In the preferred embodiment, the chaps are comprised of two leg portions (16, 18), an upper portion (19), the upper portion having a yoke portion (20), the yoke portion having a waist belt (21), whereby the chaps may be worn without trousers and provide protection to the rider. The invention discloses that each leg portion may have an off-center seam (22) and the seam may be set off-center (23) by one half inch. Each leg portion may include a snap connection (24) for raising the lower part of the leg portion. The waist belt may comprise belt tips (26) adapted for use with a buckle set, or the waist belt may include a concho (27). The yoke portion may include an inner pocket (28) and each leg portion may include a boot contour (29) and/or fringe (30).

8 Claims, 2 Drawing Sheets

CHAPS

FIELD OF THE INVENTION

The present invention relates generally to the field of riding chaps.

BACKGROUND ART

A variety of chaps are known in the prior art which are worn over ordinary pants to protect the legs of a person riding a horse. Such chaps are typically made from two pieces of leather which fit over the legs. A belt section, often referred to as the yoke, is used to connect the leg sections to the user just below the user's waist. In the prior art, the crotch and buttocks of the chaps are open and, accordingly, the chaps are worn over conventional trousers.

Because chaps known in the prior art are worn with trousers, and thus result in two layers of clothing, they are often bulky and cumbersome to wear. As a result, the user may feel a great deal of discomfort and become overheated when wearing them. Additionally, zippers up each leg are often required so that the chaps will fit more easily over trousers. Chaps known in the prior art do not provide the comfort, proper fit, and ascetic benefits necessary for riding and competition.

Hence, it would be useful to provide chaps which could be worn without trousers, would protect the rider's legs, and which are cut so as to provide comfort and a smooth appearance when riding.

DISCLOSURE OF THE INVENTION

With parenthetical reference to the corresponding parts, portions or surfaces of the disclosed embodiment, merely for the purposes of illustration and not by way of limitation, the present invention provides an improved pair of chaps (15) for use by a rider when riding a horse. The improvement comprises two leg portions (16, 18), an upper portion (19), the upper portion having a yoke portion (20), the yoke portion having a waist belt (21), whereby the chaps may be worn without trousers and provide protection to the rider.

Each leg portion may have an off-center seam (22) and the seam may be set off-center (23) by one half inch. Each leg portion may include a snap connection (24) for raising the lower part of the leg portion. The waist belt may comprise belt tips (26) adapted for use with a buckle set, or the waist belt may include a concho (27). The yoke portion may include an inner pocket (28) and each leg portion may include a boot contour (29) and/or fringe (30).

Accordingly, the general object of the present invention is to provide an improved pair of chaps which may be worn without trousers.

Another object is to provide an improved pair of chaps which have a seam positioned such that it is located in a comfortable position when the user is riding a horse.

Another object is to provide an improved pair of chaps which allow for the lower portions of the legs to be suspended above the ground when the user is walking.

Another object is to provide an improved pair of chaps which may be worn with traditional riding paraphernalia such as belt sets and conchos.

Another object is to provide an improved pair of chaps which have an inside pocket which is not in view when worn by the user.

Another object is to provide an improved pair of chaps which may be worn comfortably with riding boots.

Another object is to provide an improved pair of chaps which attach at the waist line.

DESCRIPTION OF THE PREFERRED EMBODIMENTS

Figure 3:
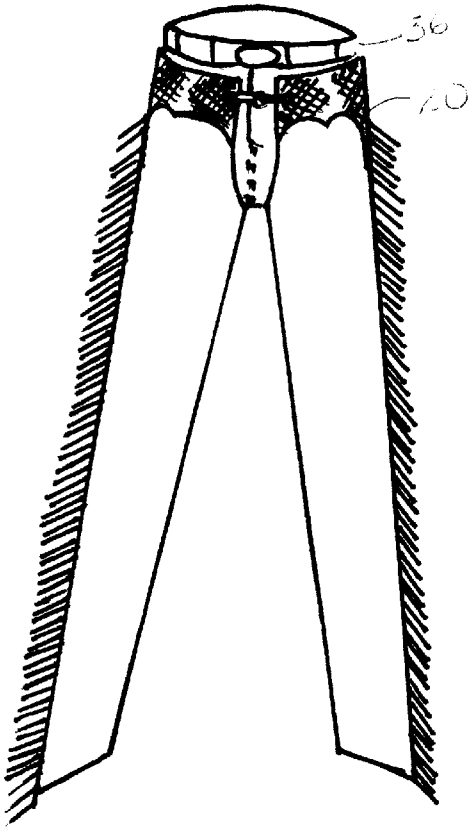
FIG. 3. Prior Art
FIG. 3 is a front view of chaps known in the prior art as worn with trousers.
Figure 2:
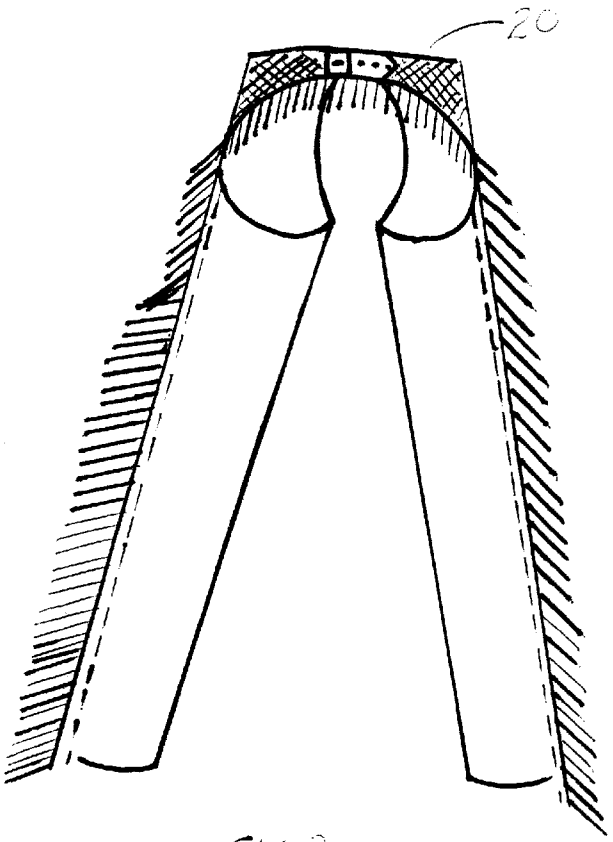
FIG. 2. Prior Art
FIG. 2 is rear view of chaps known in the prior art and shown in FIG. 1.
Figure 1:
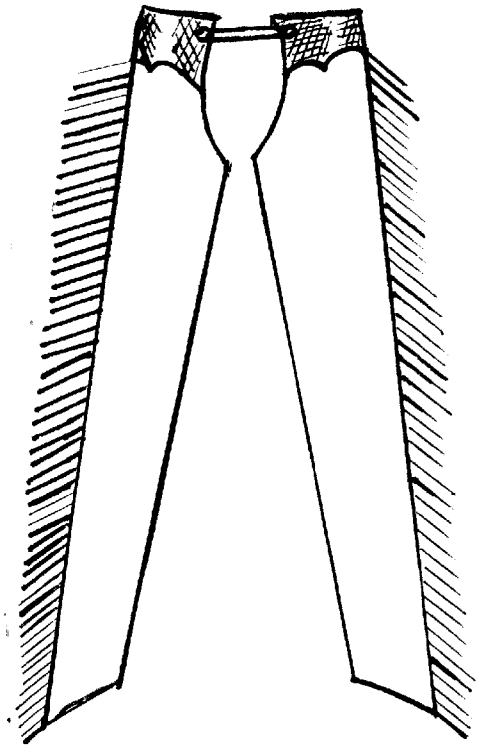
FIG. 1. Prior Art
FIG. 1 is a front view of chaps known in the prior art.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, debris, etc.) together with the specification, and are to be considered a portion of the entire written description of this invention. As used in the following description, the terms "horizontal", "vertical", "left", "right", "up" and "down", as well as adjectival and adverbial derivatives thereof, (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or access of rotation, as appropriate.

Figure 6:
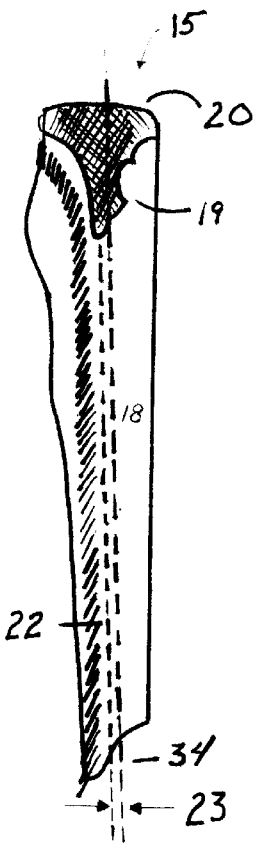
FIG. 6 is a side view of the improved chaps shown in FIG. 4.
Figure 5:
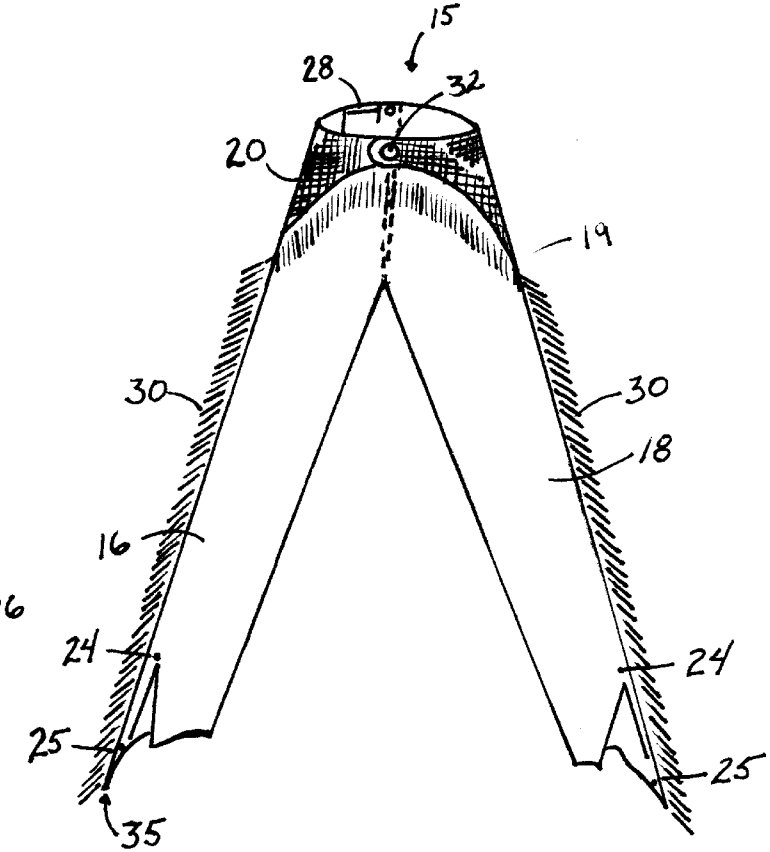
FIG. 5 is a rear view of the improved chaps shown in FIG. 4.
Figure 4:
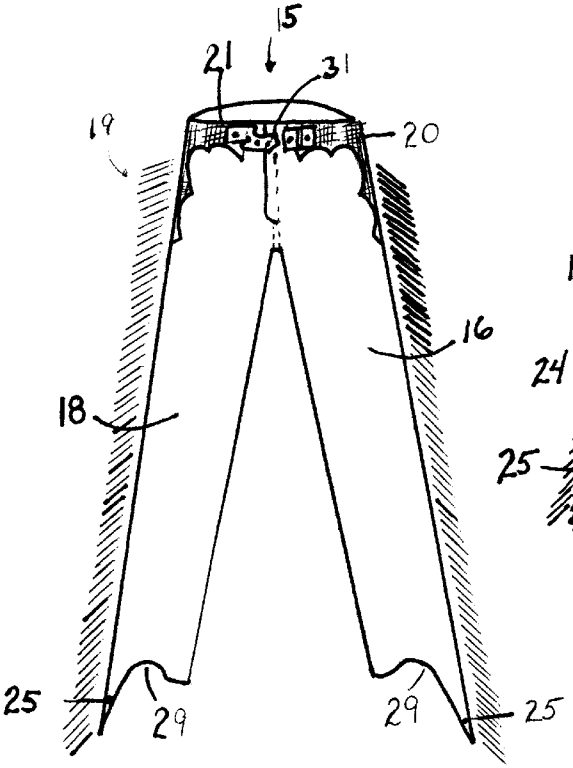
FIG. 4 is a front view of the improved chaps.

Referring now to the drawings and, more particularly, to FIGS. 4–6 thereof, this invention provides an improved pair of chaps, the presently preferred embodiment of which is generally indicated at 15. Chaps 15 are shown as broadly including a first leg portion 16, a second leg portion 18, and an upper portion 19.

As shown in FIGS. 4–6, upper portion 19 is continuous and, unlike chaps known in the prior art, covers both the buttocks and crotch area of the person wearing them. As shown in FIG. 4, upper portion 19 includes a yoke portion 20. Yoke portion 20 may be made of various materials, including suede, leather or cloth, and can be of a number of standard designs, including yoke leaf or basket weave. As shown in FIG. 4, yoke 20 includes a waist belt 21 which attaches at the front and back of the user. Waist belt 21 is configured so as to attach at the users waist line 36. Waist belt 21 is shown as including a front closure 31 and a back closure 32. Front closure 31 includes a conventional zipper and brass button. Front closure 31 may include conventional belt tips 26*a* and 26*b* (not shown). Belt tips 26*a* and 26*b* allow for the user to wear a conventional champion buckle or buckle set. In the preferred embodiment, back closure 32, as shown in FIG. 5, is a conventional concho 27. Alternatively, back closure 32 may be a conventional buckle set or a conventional button closure.

As shown in FIG. 6, second leg portion 18 includes seam 22. Seam 22 is set-off from center line 34 by off-center gap 23. In the preferred embodiment, off-center gap 23 is one half inch. Similarly, first leg portion 16 includes a seam, which is set-off from the center line of the leg portion by an off-center gap of, in the preferred embodiment, one half inch. First leg portion 16 and second leg portion 18, as shown in FIGS. 4 and 5, include a male snap connection 24 and a female snap connection 25 configured such that the bottom of first leg portion 16 and second leg portion 18 may be rolled up and male snap connection 24 connected to female connection 25. In this way, the bottom portions of first leg portion 16 and second leg portion 18 are raised above the ground when chaps 15 are worn. In the preferred embodiment, female snap connection 25 is located one inch above tip 35 of boot contour 29. Male snap connection 24 is located six inches from tip 35. Male snap connection 24 and female snap connection 25 allow the excess fringe and boot contour to be raised out of the way while the user is walking.

In the preferred embodiment, first leg portion 16 and second leg portion 18 are provided with a boot contour 29 at the bottom of the respective leg portions. As shown, boot contour 29 is not a traditional straight cut, but has a curved contour from the inseam to outer seam 22. Boot contour 29 is such that, when worn, first leg portion 16 and second leg portion 18 are longer than traditional chaps.

As shown in FIGS. 4–6, seam 22 contains fringe 30. Fringe 30 is four to five inches in length, and three sixteenths of an inch in thickness such that it will lie straight when the user is wearing chaps 15 and is seated in a saddle.

In the preferred embodiment, as shown in FIG. 5, yoke portion 20 is provided with an inner pocket 28. Inner pocket 28 includes a zipper and is located such that, when chaps 15 are worn, inner pocket 28 is not visible. In the preferred embodiment, inner pocket 28 is five inches long and three inches deep.

Modifications

The present invention contemplates that many changes and modifications may be made. The particular materials of which the various body parts and component parts are formed are not deemed critical and may be readily varied.

Therefore, while the presently-preferred form of the chaps has been shown and described, and several modifications discussed, persons skilled in the art will readily appreciate that various additional changes and modifications may be made without departing from the spirit of the invention, as defined and differentiated by the following claims.

What is claimed is:

1. A pair of chaps for use by a rider when riding a horse, comprising in combination, each of the leg portions of the chaps having a lower curved boot contour;

height adjustable fasteners secured along a lower area of the leg portions, an upper portion of the chaps having a yoke section with a waist belt, and said upper portion and lower portion encompassing a body of the wearer from the belt to the curved boot contour.

2. The chaps as set forth in claim 1, wherein said leg portions have an off-center seam.

3. The chaps as set forth in claim 2, wherein said seam is set off-center by ½ inch.

4. The chaps as set forth in claim 1, wherein said waist belt comprises belt tips adapted for use with a buckle set.

5. The chaps as set forth in claim 1, wherein said waist belt includes a concho.

6. The chaps as set forth in claim 1, wherein said yoke portion includes an inner pocket.

7. The chaps as set forth in claim 1, wherein said leg portions include fringe.

8. The chaps as set forth in claim 1, wherein said waist belt is adapted to attach at said rider's waist line.

* * * * *